US011396638B2

(12) United States Patent
Greaves et al.

(10) Patent No.: US 11,396,638 B2
(45) Date of Patent: Jul. 26, 2022

(54) MODIFIED OIL SOLUBLE POLYALKYLENE GLYCOLS

(71) Applicant: Dow Global Technologies LLC, Midland, MI (US)

(72) Inventors: Martin R. Greaves, Baar (CH); Yaokun Han, Shanghai (CN); Yong Zhao, Shanghai (CN)

(73) Assignee: Dow Global Technologies LLC, Midland, MI (US)

( * ) Notice: Subject to any disclaimer, the term of this patent is extended or adjusted under 35 U.S.C. 154(b) by 89 days.

(21) Appl. No.: 16/957,433

(22) PCT Filed: Dec. 25, 2017

(86) PCT No.: PCT/CN2017/118223
§ 371 (c)(1),
(2) Date: Jun. 24, 2020

(87) PCT Pub. No.: WO2019/126924
PCT Pub. Date: Jul. 4, 2019

(65) Prior Publication Data
US 2020/0332217 A1 Oct. 22, 2020

(51) Int. Cl.
*C10M 145/38* (2006.01)
*C10M 169/04* (2006.01)
*C10N 20/02* (2006.01)
*C10N 30/02* (2006.01)

(52) U.S. Cl.
CPC ..... *C10M 145/38* (2013.01); *C10M 169/041* (2013.01); *C10M 2203/1006* (2013.01); *C10M 2203/1025* (2013.01); *C10M 2205/0285* (2013.01); *C10M 2209/105* (2013.01); *C10M 2209/106* (2013.01); *C10N 2020/02* (2013.01); *C10N 2030/02* (2013.01)

(58) Field of Classification Search
CPC ..... C10M 2209/108; C10M 2209/109; C10M 2209/105; C10M 2209/106; C10M 2209/103; C10M 2209/107; C10M 145/38; C10M 169/041; C10M 2203/1006; C10M 2003/1025; C10M 2205/0285; C10N 2020/02; C10N 2030/02; C10N 2030/06
See application file for complete search history.

(56) References Cited

U.S. PATENT DOCUMENTS

| | | | | |
|---|---|---|---|---|
| 2,620,304 | A | 12/1952 | Stewart et al. | |
| 2,620,308 | A | 12/1952 | Stewart et al. | |
| 3,681,247 | A | 8/1972 | Wann | |
| 3,871,837 | A | 3/1975 | Bedague | |
| 4,959,169 | A | 9/1990 | McGraw et al. | |
| 4,968,453 | A | 11/1990 | Wada et al. | |
| 5,698,502 | A | 12/1997 | Pafford et al. | |
| 5,916,854 | A | 6/1999 | Inaya et al. | |
| 6,891,048 | B2 | 5/2005 | Yamane et al. | |
| 8,058,386 | B2 | 11/2011 | Pavlin | |
| 8,168,572 | B2 | 5/2012 | Thoen et al. | |
| 8,969,271 | B2 | 3/2015 | Greaves et al. | |
| 9,556,394 | B2 | 1/2017 | Khelidj et al. | |
| 9,957,455 | B2 | 5/2018 | Voelkel et al. | |
| 9,957,462 | B2 | 5/2018 | Guerin et al. | |
| 2009/0247407 | A1 | 10/2009 | Kravets et al. | |
| 2010/0120639 | A1* | 5/2010 | Thoen | C10M 169/04 508/304 |
| 2014/0249063 | A1 | 9/2014 | Greaves et al. | |
| 2014/0303053 | A1 | 10/2014 | Greaves | |
| 2015/0337230 | A1* | 11/2015 | Delbridge | C10M 141/02 508/175 |
| 2016/0068780 | A1 | 3/2016 | Greaves et al. | |
| 2016/0272916 | A1* | 9/2016 | Kashani-Shirazi | C10M 145/38 |
| 2017/0211009 | A1 | 7/2017 | Khelidj et al. | |
| 2017/0218296 | A1 | 8/2017 | Khelidj et al. | |

(Continued)

FOREIGN PATENT DOCUMENTS

| | | | |
|---|---|---|---|
| CN | 103289798 | A | 9/2013 |
| CN | 103314031 | A | 9/2013 |
| EP | 0664331 | | 7/1995 |
| EP | 2471856 | A1 | 7/2012 |

(Continued)

OTHER PUBLICATIONS

International Search Report & Written Opinion for related PCT Application PCT/CN2017/118223, dated Sep. 7, 2018 (10 pgs).

*Primary Examiner* — Latosha Hines

(74) *Attorney, Agent, or Firm* — Brooks, Cameron & Huebsch, PLLC

(57) ABSTRACT

The present disclosure provides for a lubricant formulation and a method of forming the lubricant formulation for use in an internal combustion engine. The lubricant formulation includes a base oil and an esterified oil-soluble polyalkylene glycol (E-OSP) of Formula (I): $R^1\ [O(R^2O)_n(R^3O)_m(C{=}O)R^4]_p$ wherein $R^1$ is a linear alkyl having 1 to 18 carbon atoms, a branched alkyl having 4 to 18 carbon atoms or an aryl with 6 to 30 carbon atoms; $R^2O$ is an oxypropylene moiety derived from 1, 2-propylene oxide; $R^3O$ is an oxybutylene moiety derived from butylene oxide, wherein $R^2O$ and $R^3O$ are in a block or a random distribution; $R^4$ is a linear alkyl with 1 to 18 carbon atoms, a branched alkyl with 4 to 18 carbon atoms or an aryl with 6 to 18 carbon atoms; n and m are each independently integers ranging from 0 to 20 wherein n+m is greater than 0, and p is an integer from 1 to 4.

18 Claims, No Drawings

(56) References Cited

U.S. PATENT DOCUMENTS

| | | | |
|---|---|---|---|
| 2018/0223217 | A1 | 8/2018 | Obrecht |
| 2018/0245017 | A1 | 8/2018 | Kotnis et al. |

FOREIGN PATENT DOCUMENTS

| | | |
|---|---|---|
| JP | 2004300241 | 10/2004 |
| WO | 95/03379 | 2/1995 |

* cited by examiner

MODIFIED OIL SOLUBLE POLYALKYLENE GLYCOLS

This application is a National Stage Application under 35 U.S.C. § 371 of International Application Number PCT/CN2017/118223, filed Dec. 25, 2017 and published as WO 2019/126924 on Jul. 4, 2019, the entire contents of which are incorporated herein by reference in its entirety.

TECHNICAL FIELD

The present disclosure relates to polyalkylene glycols, and more specifically to modified oil soluble polyalkylene glycols.

BACKGROUND

The majority of lubricants used today in equipment are manufactured using a hydrocarbon base oil. This is typically a mineral oil or a synthetic hydrocarbon oil (such as a polyalphaolefin). The American Petroleum Institute (API) has segmented hydrocarbon base oils into Group I, II, III and IV base oils based on their viscosity indices, saturate levels and sulphur levels.

A macro-trend in the industry is to develop more energy efficient lubricants by using fluids with better friction control (lower friction coefficients). In addition there is a need for lubricants having a higher viscosity index. Group IV base oils (polyalphaolefins, PAO) have the highest VI values, but are expensive. Group III base oils have higher values than Groups I and II base oils.

Viscosity indices are a measure of how much the viscosity of an oil changes over a temperature range. It is derived from a calculation based on the kinematic viscosity at 40° C. and 100° C. using ASTM D2270. Higher viscosity index values correspond to less change in viscosity over this temperature range. Lubricants having a high viscosity index are desirable so as to maintain a more consistent viscosity over a broad temperature range. For example in an automotive engine if the oil viscosity becomes too high, then fuel efficiency decreases. If the oil viscosity becomes too low, excessive engine wear can occur. Fluids that show only minor changes in viscosity (i.e, they have a high viscosity index) across this temperature range are desired.

Viscosity index improvers are additives that tend to reduce the change in oil viscosity over a temperature range. Typical viscosity index improvers include, for example, polyalkylmethacrylates and olefin copolymers. Unfortunately, while viscosity index improvers can increase the viscosity index of engine oil, they also tend to increase the viscosity of the engine oil at low temperature (e.g., 0° C. or −10° C.). Low temperature viscosity is important to consider when starting an engine in low temperature environments. While it is important for an engine oil to form a film that is viscous enough to prevent wear in order to protect engine components, it is also important that the engine oil is not so viscous so as to cause high frictional losses due to excessive viscous drag from the oil. Therefore, it is highly desirable to find additives or co-base fluids which also reduce low temperature viscosity (e.g., at 0° C.).

Oil-Soluble Polyalkylene Glycols (OSP) sold under the tradename UCON™ OSPs have kinematic viscosities at 100° C. ($KV_{100}$) between 3 and 150 centistokes (cSt). Unlike conventional polyalkylene glycols (PAG) derived from ethylene oxide (EO) and propylene oxide (PO), OSPs are soluble in hydrocarbon oils. Today the majority of lubricants are based on hydrocarbon oils. OSPs are being used as co-base oils (10-50 weight percent (wt. %) based on weight of total composition) and additives (up to 10 wt. % based on weight of total composition) in hydrocarbon based formulations due to their excellent solubility. OSPs offer excellent performance functionality and can improve friction control (which helps fuel economy in automotive lubricants) and deposit control (which helps fluid longevity).

The lower viscosity members of the above noted OSPs are of special interest to automotive lubricant formulators. Unfortunately low viscosity OSPs also have low viscosity index values (e.g., viscosity index=120). It would be preferable to improve the viscosity index values of OSPs through a chemical modification and use these as components in hydrocarbon oils. As such, there is a need in the art to develop OSPs to accomplish this, such that when they are added to hydrocarbon oils they are soluble and boost the viscosity index values and in addition improve their low temperature properties.

SUMMARY

The present disclosure provides for Oil-Soluble Polyalkylene Glycols (OSPs) that are both soluble and boost the viscosity index values of hydrocarbon oils while also improving the low temperature properties of the resulting lubricant formulation. These surprising and unexpected properties are the result of esterified OSPs, which serve as effective viscosity index improvers and effective low temperature viscosity reducing agents when added to hydrocarbon base oils used for lubricant formulations. In addition the esterified OSPs of the present disclosure also show benefits as friction modifiers in hydrocarbon base oils.

The present disclosure provides for a lubricant formulation that includes a base oil and an esterified oil-soluble polyalkylene glycol (E-OSP) of Formula I:

$$R^1[O(R^2O)_n(R^3O)_m(C{=}O)R^4]_p \qquad \text{Formula I}$$

where $R^1$ is a linear alkyl having 1 to 18 carbon atoms, a branched alkyl having 4 to 18 carbon atoms or an aryl with 6 to 30 carbon atoms; $R^2O$ is an oxypropylene moiety derived from 1,2-propylene oxide; $R^3O$ is an oxybutylene moiety derived from butylene oxide, where $R^2O$ and $R^3O$ are in a block or a random distribution; $R^4$ is a linear alkyl with 1 to 18 carbon atoms, a branched alkyl with 4 to 18 carbon atoms or an aryl with 6 to 18 carbon atoms; n and m are each independently integers ranging from 0 to 20 where n+m is greater than 0, and p is an integer from 1 to 4. The present disclosure also provides for a method of forming the lubricant formulation for an internal combustion engine. The method includes providing the base oil, as described herein, and admixing with the base oil the E-OSP of Formula I, as described herein, to form the lubricant formulation for the internal combustion engine. The lubricant formulation is preferably used with internal combustion engines.

The present disclosure further includes embodiments of the lubricant formulation in which $R^3O$ is derived from 1,2-butylene oxide. Other preferred values for the E-OSP of Formula I include where $R^4$ is a linear alkyl with 1 to 8 carbon atoms. Preferably, $R^1$ is a linear alkyl with 10 to 14 carbon atoms.

The lubricant formulation of the present disclosure can further include an oil-soluble polyalkylene glycol (OSP) of Formula II:

$$R^1[O(R^2O)_n(R^3O)_m]_p{-}H \qquad \text{Formula II}$$

where $R^1$ is a linear alkyl having 1 to 18 carbon atoms, a branched alkyl having 4 to 18 carbon atoms or an aryl with 6 to 18 carbon atoms; $R^2O$ is an oxypropylene moiety derived from 1,2-propylene oxide; $R^3O$ is an oxybutylene moiety derived from butylene oxide, where $R^2O$ and $R^3O$ are in a block or a random distribution; n and m are each independently integers ranging from 0 to 20 where n+m is greater than 0, and p is an integer from 1 to 4, where the OSP of Formula II is soluble in the base oil. The lubricant formulation of the present disclosure can also include an oil-soluble acid of Formula III:

$$R^4—COOH \qquad \text{Formula III}$$

$R^4$ is a linear alkyl with 1 to 18 carbon atoms, a branched alkyl with 4 to 18 carbon atoms or an aryl with 6 to 18 carbon atoms, where the acid of Formula III is soluble in the base oil. The compounds of Formulae II and 111 can be formed from the hydrolysis of the E-OSP of Formula I. The preferred values for n and m in each of Formulae I, II and III are each independently integers ranging from 5 to 10.

The lubricant formulation of the present disclosure can include 90 to 99.9 weight percent (wt. %) of the base oil and 10 to 0.01 wt. % of the E-OSP of Formula I, where the wt. % is based on the total weight of the lubricant formulation. In a preferred embodiment, the lubricant formulation includes 95 wt. % of the base oil and 5 wt. % of the E-OSP of Formula I. The base oil for the lubricant formulation is selected from the group consisting of an American Petroleum Institute (API) Group I hydrocarbon base oil, an API Group II hydrocarbon base oil, an API Group III hydrocarbon base oil, an API Group IV hydrocarbon base oil and a combination thereof. Preferably, the base oil of the lubricant formulation is an API Group III hydrocarbon base oil.

The above summary of the present disclosure is not intended to describe each disclosed embodiment or every implementation of the present disclosure. The description that follows more particularly exemplifies illustrative embodiments. In several places throughout the application, guidance is provided through lists of examples, which examples can be used in various combinations. In each instance, the recited list serves only as a representative group and should not be interpreted as an exclusive list.

DETAILED DESCRIPTION

The present disclosure provides for OSPs that are both soluble and boost the viscosity index values of hydrocarbon oils while also improving the low temperature properties of the resulting lubricant formulation. These surprising and unexpected properties are the result of esterified OSPs, which serve as effective viscosity index improvers and effective low temperature viscosity reducing agents when added to hydrocarbon base oils used for lubricant formulations. In addition the esterified OSPs of the present disclosure also show benefits as friction modifiers in hydrocarbon base oils. The esterified OSPs of the present disclosure are particularly useful as an additive (up to 10 wt. % based on weight of total composition) with a base oil to form a lubricant formulation that is useful in an internal combustion engine.

The present disclosure provides for a lubricant formulation that includes a base oil and an esterified oil-soluble polyalkylene glycol (E-OSP) of Formula I:

$$R^1[O(R^2O)_n(R^3O)_m(C{=}O)R^4], \qquad \text{Formula I}$$

$R^1$ is a linear alkyl having 1 to 18 carbon atoms, a branched alkyl having 4 to 18 carbon atoms or an aryl with 6 to 30 carbon atoms. Preferably, $R^1$ is a linear alkyl with 10 to 14 carbon atoms. $R^2O$ is an oxypropylene moiety derived from 1,2-propylene oxide, where the resulting structure of $R^2O$ in Formula I can be either [$—CH_2CH(CH_3)—O—$] or [$—CH(CH_3)CH_2—O—$]. $R^3O$ is an oxybutylene moiety derived from butylene oxide, where the resulting structure of $R^3O$ in Formula I can be either [$—CH_2CH(C_2H_5)—O—$] or [$—CH(C_2H_5)CH_2—O—$] when $R^3O$ is derived from 1,2-butylene oxide. When $R_3O$ is derived from 2,3 butylene oxide the oxybutylene moiety will be [$—OCH(CH_3)CH(CH_3)—$]. For the various embodiments, $R^2O$ and $R^3O$ are in a block or a random distribution in Formula I. $R^4$ is a linear alkyl with 1 to 18 carbon atoms, a branched alkyl with 4 to 18 carbon atoms or an aryl with 6 to 18 carbon atoms. Preferably, $R^4$ is a linear alkyl with 1 to 8 carbon atoms. The values for n and m are each independently integers ranging from 0 to 20, where n+m is greater than 0. The value for p is an integer from 1 to 4.

The E-OSP of the present disclosure can have one or more properties that are desirable for various applications. For instance, viscosity index is a measure of how the viscosity of the lubricant changes with temperature. For lubricants, relatively lower viscosity index values can indicate a greater reduction in a lubricant's viscosity at higher temperatures, as compared to a lubricant having a relatively higher viscosity index value. As such, for a number of applications, relatively higher viscosity index values are advantageous so that the lubricant maintains a generally steady viscosity with less pronounced viscosity changes for extremes of temperatures that go from lower temperatures to higher temperatures. The E-OSP disclosed herein can provide higher viscosity index values, as compared to some other lubricants.

The E-OSP disclosed herein are also low viscosity lubricants as they have a kinematic viscosity at 40° C. of less than 25 centistokes (cSt) and a kinematic viscosity at 100° C. of 6 cSt or less (both kinematic viscosities measured according to ASTM D7042). As such, the E-OSPs may advantageously be utilized as low viscosity lubricants and/or for various low viscosity lubricant applications. The E-OSPs may have a kinematic viscosity, as determined by ASTM D7042, at 40° C. from a lower limit 8.0 or 9.0 cSt to an upper limit of 24.5 or 24.0 cSt. The E-OSPs may have a kinematic viscosity, as determined by ASTM D7042, at 100° C. from a lower limit 1.0 or 2.5 cSt to an upper limit of 6.0 or 5.5 cSt. As mentioned, the E-OSPs disclosed herein can advantageously provide relatively lower viscosities at low temperatures, as compared to some other lubricants, such as similar non-esterified oil soluble polyalkylene glycols. Additionally, low viscosity lubricants having a relatively lower viscosity, e.g., kinematic and/or dynamic, at low temperatures, such as at or below 0° C., can advantageously help to provide lower energy losses, such as when pumping the lubricant around an automotive engine. The esterified oil soluble polyalkylene glycols disclosed herein can provide relatively lower viscosities e.g., kinematic and/or dynamic, at low temperatures, as compared to some other lubricants.

The E-OSP of Formula I is a reaction product of an oil soluble polyalkylene glycol and an acid. Unlike mineral oil base oils, oil soluble polyalkylene glycols have a significant presence of oxygen in the polymer backbone. Embodiments of the present disclosure provide that oil soluble polyalkylene glycols are alcohol initiated copolymers of propylene oxide and butylene oxide, where units derived from butylene oxide are from 50 weight percent to 95 weight percent based upon a total of units derived from propylene oxide and butylene oxide. All individual values and subranges from 50 weight percent to 95 weight percent are included; for example, the oil soluble polyalkylene glycol may have units derived from butylene oxide from a lower limit of 50, 55, or 60 weight percent to an upper limit of 95, 90, or 85 weight percent based upon the total of units derived from propylene oxide and butylene oxide. For the various embodiments, the propylene oxide can be 1,2-propylene oxide and/or 1,3-propylene oxide. For the various embodiments, the butylene oxide can be selected from 1,2-butylene oxide or 2,3-butylene oxide. Preferably, 1,2-butylene oxide is used in forming the oil soluble polyalkylene glycol.

The alcohol initiator for the oil soluble polyalkylene glycol may be a monol, a diol, a triol, a tetrol, or a combination thereof. Examples of the alcohol initiator include, but are not limited to, monols such as methanol, ethanol, butanol, octanol and dodecanol. Examples of diols are ethylene glycol, 1,2-propylene glycol, 1,3-propylene glycol and 1,4 butanediol. Examples of triols are glycerol and trimethylolpropane. An example of a tetrol is pentaerythritiol. Combinations of monols, diols, triols and/or tetrol may be used. The alcohol initiator may include from 1 to 30 carbon atoms. All individual values and subranges from 1 to 30 carbon atoms are included; for example, the alcohol initiator may have from a lower limit of 1, 3, or 5 carbon atoms to an upper limit of 30, 25, or 20 carbon atoms.

The oil soluble polyalkylene glycols may be prepared by a known process with known conditions. The oil soluble polyalkylene glycols may be obtained commercially. Examples of commercial oil soluble polyalkylene glycols include, but are not limited to, oil soluble polyalkylene glycols under the trade name UCON™, such as UCON™ OSP-12 and UCON™ OSP-18 both available from The Dow Chemical Company.

The acid that is reacted with the oil soluble polyalkylene glycol to form the esterified oil soluble polyalkylene glycols disclosed herein can be a carboxylic acid. Examples of such carboxylic acids include, but are not limited to, acetic acid, propanoic acid, pentanoic acid, e.g., n-pentanoic acid, valeric acid, e.g., isovaleric acid, caprylic acid, dodecanoic acid, combinations thereof.

To form the E-OSP disclosed herein, the oil soluble polyalkylene glycol and the acid may be reacted at a molar ratio of 10 moles of oil soluble polyalkylene glycol:1 mole of acid to 1 mole of oil soluble polyalkylene glycol:10 moles of acid. All individual values and subranges from 10:1 moles of oil soluble polyalkylene glycol to moles of acid to 1:10 moles of oil soluble polyalkylene glycol to moles of acid are included; for example oil soluble polyalkylene glycol and the acid may be reacted at a molar ratio of 10:1, 9:1, 8:1, 7:1, 6:1, 5:1, 4:1, 3:1, 2:1, 1:1, 1:2, 1:3, 1:4, 1:5, 1:6, 1:7, 1:8, 1:9, or 1:10 moles of oil soluble polyalkylene glycol to moles of acid.

The E-OSP may be prepared by a known process with known conditions. For instance, the esterified oil soluble polyalkylene glycols disclosed herein may be formed by an esterification process, e.g., Fisher Esterification. Generally, the reactions for the esterification process can take place at atmospheric pressure (101,325 Pa), at a temperature of 60 to 110° C. for 1 to 10 hours. In addition, known components such as acid catalysts, neutralizers, and/or salt absorbers, among other known components, may be utilized in the esterification reaction. An example of a preferred acid catalyst is p-toluenesulfonic acid, among others. Examples of neutralizers are sodium carbonate and potassium hydroxide, among others. An example of a salt absorber is magnesium silicate, among others.

As discussed above, the E-OSP of the present disclosure has the structure of Formula I:

$$R^1[O(R^2O)_n(R^3O)_m(C{=}O)R^4]_p \qquad \text{Formula I}$$

$R^1$ is a linear alkyl having 1 to 18 carbon atoms, a branched alkyl having 4 to 18 carbon atoms or an aryl with 6 to 30 carbon atoms. Preferably. $R^1$ is a linear alkyl with 10 to 14 carbon atoms. $R^1$ corresponds to the residual of an alcohol initiator used during the polymerization of the oil soluble polyalkylene glycol discussed herein. As used herein, "alkyl group" refers to a saturated monovalent hydrocarbon group. As used herein an "aryl group" refers to a mono- or polynuclear aromatic hydrocarbon group; the aryl group may include an alkyl substituent. The aryl group, including the alkyl substituent when present, for $R^1$ can have 6 to 30 carbons.

$R^2O$ is an oxypropylene moiety derived from 1,2-propylene oxide, where the resulting structure of $R^2O$ in Formula I can be either [—$CH_2CH(CH_3)$—O—] or [—$CH(CH_3)CH_2$—O—]. $R^3O$ is an oxybutylene moiety derived from butylene oxide, where the resulting structure of $R^3O$ in Formula I can be either [—$CH_2CH(C_2H_5)$—O—] or [—$CH(C_2H_5)CH_2$—O—] when $R^3O$ is derived from 1,2-butylene oxide. For the various embodiments, $R^2O$ and $R^3O$ are in a block or a random distribution in Formula I.

$R^4$ is a linear alkyl with 1 to 18 carbon atoms, a branched alkyl with 4 to 18 carbon atoms or an aryl with 6 to 18 carbon atoms. Preferably, $R^4$ is a linear alkyl with 1 to 8 carbon atoms. As used herein, "alkyl group" refers to a saturated monovalent hydrocarbon group. As used herein an "aryl group" refers to a mono- or polynuclear aromatic hydrocarbon group; the aryl group may include an alkyl substituent. The aryl group, including the alkyl substituent when present, for $R^4$ can have 6 to 18 carbons.

The values for n and m are each independently integers ranging from 0 to 20, where n+m is greater than 0. Preferably, n and m are each independently integers ranging from 5 to 10. In another preferred embodiment, n and m are each independently integers ranging from 3 to 5. The value for p is an integer from 1 to 4.

The E-OSPs disclosed herein may have a viscosity index determined according to ASTM D2270 from 130 to 200. All individual values and subranges from 130 to 200 are included; for example, the E-OSPs may have a viscosity index from a lower limit of 130 or 135 to an upper limit of 200 or 195. This improved viscosity index, as compared to some other lubricants, such as similar non-esterified oil soluble polyalkylene glycols, is advantageous to previous a previous process for increasing viscosity index, i.e. an alkylation capping process, because esterification can be achieved via a simpler process and/or at a reduced cost.

The lubricant formulation of the present disclosure also includes a base oil, where the E-OSPs are oil soluble (are miscible) in the base oil. The lubricant formulation of the present disclosure can include 90 to 99.9 weight percent (wt. %) of the base oil and 10 to 0.01 wt. % of the E-OSP of Formula I, where the wt. % is based on the total weight of the lubricant formulation. In a preferred embodiment, the lubricant formulation includes 95 wt. % of the base oil and 5 wt. % of the E-OSP of Formula I.

The base oil for the lubricant formulation is selected from the group consisting of an American Petroleum Institute (API) Group I hydrocarbon base oil, an API Group II hydrocarbon base oil, an API Group III hydrocarbon base oil, an API Group IV hydrocarbon base oil and a combination thereof. Preferably, the base oil of the lubricant formulation is an API Group III hydrocarbon base oil. The composition of API Group I-IV hydrocarbon oils are as follows. Group II and Group III hydrocarbon oils are typically prepared from conventional Group I feed stocks using a severe hydrogenation step to reduce the aromatic, sulfur and nitrogen content, followed by de-waxing, hydro-finishing, extraction and/or distillation steps to produce the finished base oil. Group II and III base stocks differ from conventional solvent refined Group I base stocks in that their sulfur, nitrogen and aromatic contents are very low. As a result, these base oils are compositionally very different from conventional solvent refined base stocks. The API has categorized these different base stock types as follows: Group I, >0.03 wt. % sulfur, and/or <90 vol % saturates, viscosity index between 80 and 120; Group II, ≤0.03 wt. % sulfur, and ≥90 vol % saturates, viscosity index between 80 and 120; Group III, ≤0.03 wt. % sulfur, and ≥90 vol % saturates, viscosity index >120. Group IV are polyalphaolefins (PAO). Hydrotreated base stocks and catalytically dewaxed base stocks, because of their low sulfur and aromatics content, generally fall into the Group II and Group III categories.

The E-OSPs of the present disclosure help to increase a viscosity index of the base oil having a kinematic viscosity of at least 80 cSt at 40° C. as measured according to ASTM D7042, while simultaneously decreasing the lubricant low temperature (0° C.) viscosity by blending esterified OSP into the base oil. In other words, the inclusion of an E-OSP into a hydrocarbon base oil leads to a desirable improvement in friction coefficients, an increase in the viscosity index and a favorable decrease in low temperature viscosity compared to the hydrocarbon base oil alone or a composition comprising a hydrocarbon oil with an oil soluble polyalkylene glycol (OSP) that has not been further esterified. The E-OSPs of the present disclosure accomplish this, such that when they are added to hydrocarbon oils they are soluble and boost their viscosity index values and in addition improve their low temperature properties. Furthermore, the E-OSPs of the present disclosure offer advantages in friction control over OSPs.

The present disclosure also provides for a method of forming the lubricant formulation for an internal combustion engine. The method includes providing the base oil, as described herein, and admixing with the base oil the E-OSP of Formula I, as described herein, to form the lubricant formulation for the internal combustion engine. The lubricant formulation is preferably used with internal combustion engines.

When used with internal combustion engines, the E-OSPs of the present disclosure can undergo a hydrolysis reaction. The products of this reaction can be acid and alcohol compounds similar to or identical to the parent acid and alcohol precursors used in forming the E-OSPS. For example, the lubricant formulation of the present disclosure can further include an oil-soluble polyalkylene glycol (OSP) of Formula II:

$$R^1[O(R^2O)_n(R^3O)_m]_p—H \qquad \text{Formula II}$$

where $R^1$ is a linear alkyl having 1 to 18 carbon atoms, a branched alkyl having 4 to 18 carbon atoms or an aryl with 6 to 18 carbon atoms; $R^2O$ is an oxypropylene moiety derived from 1,2-propylene oxide; $R^3O$ is an oxybutylene moiety derived from butylene oxide, where $R^2O$ and $R^3O$ are in a block or a random distribution; n and m are each independently integers ranging from 0 to 20 where n+m is greater than 0, and p is an integer from 1 to 4, where the OSP of Formula II is soluble in the base oil. The lubricant formulation of the present disclosure can also include an oil-soluble acid of Formula III:

$$R^4—COOH \qquad \text{Formula III}$$

$R^4$ is a linear alkyl with 1 to 18 carbon atoms, a branched alkyl with 4 to 18 carbon atoms or an aryl with 6 to 18 carbon atoms, where the acid of Formula III is soluble in the base oil. As noted above, the compounds of Formulae II and III can be formed from the hydrolysis of the E-OSPs of Formula I. The preferred values for n and m in each of Formulae I, II and III are each independently integers ranging from 5 to 10.

The lubricant formulations of the present disclosure can also contain other additives such as antioxidants, ferrous corrosion inhibitors, yellow metal passivators, viscosity index improvers, pour point depressants, anti-wear additives, extreme pressure additives, antifoams, demulsifiers, dyes.

EXAMPLES

Abbreviations

American Society for Testing and Materials (ASTM); Viscosity Index (VI); Grams (g); Degree Celsius (° C.); Mole (mol); Comparative Examples (Comp. Ex.); Inventive Examples (Ex); Kinematic Viscosity (KV), potassium hydroxide (KOH), sodium carbonate ($Na_2CO_3$) and p-toluenesulfonic acid (PTSA).

Test Methods

Use the following test methods for measuring the properties of the Examples and Comparative Examples provided herein. Measure KV according to ASTM D7042 [$KV_{40}$ is the kinematic viscosity at 40° C., $KV_{100}$ is the kinematic viscosity at 100° C., $KV_{-20}$ is the kinematic viscosity at −20° C.]. Measure pour point according to ASTM D97. Calculate VI according to ASTM D2270.

Materials

TABLE 1

Materials List for Examples and Comparative Examples

| Ingredient | Acronym | Description | Source |
|---|---|---|---|
| OIL SOLUBLE PAG BASE OILS | | | |
| UCON ™ OSP-12 | OSP-12 | Dodecanol (C12) initiated PO/BO (50/50 w/w), random copolymer with a typical kinematic viscosity at 40° C. ($KV_{40}$) of 12 cSt ($mm^2$/sec) a typical kinematic viscosity at 100° C. ($KV_{100}$) of 3 cSt and viscosity index of 103. | The Dow Chemical Company (TDCC) |
| UCON ™ OSP-18 | OSP-18 | Dodecanol initiated PO/BO (50/50 w/w), random copolymer with a typical kinematic viscosity at 40° C. of 18 cSt | TDCC |

TABLE 1-continued

| Materials List for Examples and Comparative Examples | | | |
|---|---|---|---|
| Ingredient | Acronym | Description | Source |
| | | and a typical kinematic viscosity at 100° C. ($KV_{100}$) of 4 cSt and viscosity index of 121. | |
| | | EXPERIMENTAL ESTERIFIED OSPs | |
| OSP18-C2 | OSP18-C2 | Esterified OSP18 by reaction with acetic acid (C2). Experimental sample with $KV_{40}$ of 15.9 cSt, $KV_{100}$ of 4.27 cSt, pour point of −46° C. and VI of 192. | Experimental sample |
| OSP18-C3 | OSP18-C3 | Esterified OSP18 by reaction with propionic acid (C3). Experimental sample with $KV_{40}$ of 15.2 cSt, $KV_{100}$ of 3.99 cSt, pour point of −47° C. and VI of 172. | Experimental sample |
| OSP18-C5 | OSP18-C5 | Esterified OSP18 by reaction with valeric acid (C5). Experimental sample with $KV_{40}$ of 15.3 cSt, $KV_{100}$ of 4.0 cSt, pour point of −55° C. and VI of 160. | Experimental sample |
| OSP18-iC5 | OSP18-iC5 | Esterified OSP18 by reaction with iso-valeric acid (iC5). Experimental sample with $KV_{40}$ of 15.8 cSt, $KV_{100}$ of 4.2 cSt, pour point of −55° C. and VI of 184. | Experimental sample |
| OSP18-C8 | OSP18-C8 | Esterified OSP18 by reaction with caprylic acid (C8). Experimental sample with $KV_{40}$ of 18.9 cSt, $KV_{100}$ of 4.68 cSt, pour point of −45° C. and VI of 164. | Experimental sample |
| OSP12-C5 | OSP12-C5 | Esterified OSP12 by reaction with valeric acid (C5). Experimental sample with $KV_{40}$ of 10.3 cSt, $KV_{100}$ of 3.06 cSt, pour point of −43° C. and VI of 171. | Experimental sample |
| OSP12-iC5 | OSP12-iC5 | Esterified OSP12 by reaction with iso-valeric acid (iC5). Experimental sample with $KV_{40}$ of 10.9 cSt, $KV_{100}$ of 3.1 cSt, pour point of −45° C. and VI of 153. | Experimental sample |
| OSP12-C8 | OSP12-C8 | Esterified OSP12 by reaction with caprylic acid (C8). Experimental sample with $KV_{40}$ of 12.2 cSt, $KV_{100}$ of 3.4 cSt, pour point of −45° C. and VI of 164 | Experimental sample |
| | | HYDROCARBON BASE OILS | |
| NEXBASE ™ 3060 | Gp III | API Group III hydrocarbon base oil with a $KV_{40}$ of 32.0 cSt, $KV_{100}$ of 5.9 cSt, pour point of −15° C. and VI of 128 | Neste Corporation |
| SYNFLUID ™ PAO-6 | PAO-6 | Polyalphaolefin with $KV_{40}$ of 30.5 cSt, $KV_{100}$ of 5.6 cSt, pour point of −61° C. and VI of 137 | ChevronPhillips Chemical Company |
| DURASYN ™ 180R | PAO100 | An API Group IV polyalphaolefin base oil with a typical $KV_{100}$ of 100 cSt, $KV_{40}$ of 935 cSt, VI of 201 and pour point of −39° C. | INEOS Chemical Company |
| DURASYN ™ 168 | PAO8 | An API Group IV polyalphaolefin base oil with a typical $KV_{100}$ of 7.8 cSt, $KV_{40}$ of 47.5 cSt, VI of 136 and pour point of −55° C. | INEOS Chemical Company |

The following compounds are available from Sinopharm Chemical Reagent Co. Ltd: PTSA, $Na_2CO_3$ (neutralizer), KOH (neutralizer), magnesium silicate (salt absorber), acetic acid (acid), propanoic acid (acid), caprylic acid (acid) and dodecanoic acid (acid). The following compounds are available from Energy Chemical; n-pentanoic acid (acid) and isovaleric acid (acid, containing >99 weight percent of 3-methylbutanoic acid).

Synthesis of OSP-Esters

The esterified OSP18 series and esterified OSP12 series were synthesized according to the following steps:

Esterified OSP18 Series

Esterification of OSP18 by Acetic Acid (OSP18-C2)

Stir UCON™OSP-18 (350 g, 0.749 mol) and acetic acid (45.0 g, 0.749 mol, 43.0 mL) in toluene (500 mL) at room temperature (23° C.) to form a first mixture. Add p-toluenesulfonic acid (PTSA, 1.42 g, 0.00749 mol) with stirring to the first mixture to form a second mixture. Reflux the second mixture at 135° C. for 4 hours with Dean-Stark to remove 13.0 mL water to form a third mixture. Cool the third mixture to room temperature and then add $Na_2CO_3$ (50 g) to form a fourth mixture and stir the forth mixture overnight to neutralize PTSA. Add 10 g magnesium silicate to the forth mixture to form a fifth mixture and stir at 60° C. for 3 hours to absorb the generated salt in the fifth mixture. Filter the fifth mixture through a filter paper. After filtration, remove the residue solvent by vacuum distillation to obtain a light yellow liquid (300 g, yield=79%, mol capping rate=96%).

Esterification of OSP18 by Propanoic Acid (OSP18-C3)

Stir UCON™OSP-18 (350 g, 0.749 mol) and propionic acid (55.5 g, 0.749 mol, 56.0 mL) in toluene (500 mL) at room temperature (23° C.) to form a first mixture. Add PTSA (1.42 g, 0.00749 mol) with stirring to the first mixture to form a second mixture. Reflux the second mixture at 135° C. for 5 hours with Dean-Stark to remove 13.0 mL water to form a third mixture. Cool the third mixture to room temperature and then add magnesium silicate (10 g) to form a fourth mixture and stir the forth mixture overnight to neutralize PTSA. Add magnesium silicate (10 g) to the forth mixture to form a fifth mixture and stir at 60° C. for 3 hours to absorb the generated salt in the fifth mixture. Filter the fifth mixture through a filter paper. After filtration, remove the residue solvent by vacuum distillation to obtain a light yellow liquid (310 g, yield=79%, mol capping rate=99%).

Esterification of OSP18 by n-Pentanoic Acid (OSP18-C5)

Stir UCON™OSP-18 (350 g, 0.749 mol) and n-pentanoic acid (76.5 g, 0.749 mol) in toluene (500 mL) at room temperature (23° C.) to form a first mixture. Add PTSA (1.42 g, 0.00749 mol) with stirring to the first mixture to form a second mixture. Reflux the second mixture at 165° C. for overnight with Dean-Stark to remove 13.0 mL water to form a third mixture. Cool the third mixture to room temperature and then add $Na_2CO_3$ (50 g) to form a fourth mixture and stir the forth mixture overnight to neutralize PTSA. Add magnesium silicate (10 g) to the forth mixture to form a fifth mixture and stir at 60° C. for 3 hours to absorb the generated salt in the fifth mixture. Filter the fifth mixture through a filter paper. After filtration, remove the residue solvent by vacuum distillation to obtain a dark yellow liquid (330 g, yield=80%, mol capping rate=98%).

Esterification of OSP18 by Isovaleric Acid (OSP18-iC5)

Stir UCON™OSP-18 (350 g, 0.749 mol) and isovaleric acid (76.5 g, 0.749 mol) in toluene (500 mL) at room temperature (23° C.) to form a first mixture. Add PTSA (1.42 g, 0.00749 mol) with stirring to the first mixture to form a second mixture. Reflux the second mixture at 165° C. for overnight with Dean-Stark to remove 13.0 mL water to form a third mixture. Cool the third mixture to room temperature and then add $Na_2CO_3$ (50 g) to form a fourth mixture and stir the forth mixture overnight to neutralize PTSA. Add magnesium silicate (10 g) to the forth mixture to form a fifth mixture and stir at 60° C. for 3 hours to absorb the generated salt in the fifth mixture. Filter the fifth mixture through a filter paper. After filtration, remove the residue solvent by vacuum distillation to obtain a dark yellow liquid (335 g, yield=80%, mol capping rate=97%).

Esterification of OSP18 by Caprylic Acid (OSP18-C8)

Stir UCON™OSP-18 (350 g, 0.749 mol) and caprylic acid (108 g, 0.749 mol) in toluene (500 mL) at room temperature (23° C.) to form a first mixture. Add PTSA (1.42 g, 0.00749 mol) with stirring to the first mixture to form a second mixture. Reflux the second mixture at 165° C. for 5 hours with Dean-Stark to remove 13.0 mL water to form a third mixture. Cool the third mixture to room temperature and then add $Na_2CO_3$ (50 g) to form a fourth mixture and stir the forth mixture overnight to neutralize PTSA. Add magnesium silicate (10 g) to the forth mixture to form a fifth mixture and stir at 60° C. for 3 hours to absorb the generated salt in the fifth mixture. Filter the fifth mixture through a filter paper. After filtration, remove the residue solvent by vacuum distillation to obtain a light yellow liquid (356 g, yield=80%, mol capping rate=99%).

Esterified OSP12 Series

Esterification of OSP12 by Acetic Acid (OSP12-C2)

Stir UCON™OSP-12 (374 g, 1 mol) and acetic acid (60 g, 1 mol) in toluene (500 mL) at room temperature (23° C.) to form a first mixture. Add PTSA (1.90 g, 0.001 mol) with stirring to the first mixture to form a second mixture. Reflux the second mixture at 135° C. for 3 hours with Dean-Stark to remove 18.0 mL water to form a third mixture. Cool the third mixture to room temperature and then add KOH (1.12 g, 0.002 mol) to form a fourth mixture and stir the forth mixture overnight to neutralize PTSA. Add magnesium silicate (10 g) to the forth mixture to form a fifth mixture and stir at 60° C. for 3 hours to absorb the generated salt in the fifth mixture. Filter the fifth mixture through a filter paper. After filtration, remove the residue solvent by vacuum distillation to obtain a light yellow liquid (380 g, yield=91%, mol capping rate=99%).

Esterification of OSP12 by Propionic Acid (OSP12-C3)

Stir UCON™OSP-12 (374 g, 1 mol) and propionic acid (74 g, 1 mol) in toluene (500 mL) at room temperature (23° C.) to form a first mixture. Add PTSA (1.90 g, 0.001 mol) with stirring to the first mixture to form a second mixture. Reflux the second mixture at 135° C. for 4 hours with Dean-Stark to remove 18.0 mL water to form a third mixture. Cool the third mixture to room temperature and then add KOH (1.12 g, 0.002 mol) to form a fourth mixture and stir the forth mixture overnight to neutralize PTSA. Add magnesium silicate (10 g) to the forth mixture to form a fifth mixture and stir at 60° C. for 3 hours to absorb the generated salt in the fifth mixture. Filter the fifth mixture through a filter paper. After filtration, remove the residue solvent by vacuum distillation to obtain a light yellow liquid (390 g, yield=90%, mol capping rate=99%).

Esterification of OSP12 by n-Pentanoic Acid (OSP12-C5)

Stir UCON™OSP-12 (374 g, 1 mol) and n-pentanoic acid (102 g, 1 mol) in toluene (500 mL) at room temperature (23° C.) to form a first mixture. Add PTSA (1.90 g, 0.001 mol) with stirring to the first mixture to form a second mixture. Reflux the second mixture at 135° C. for overnight with Dean-Stark to remove 18.0 mL water to form a third mixture. Cool the third mixture to room temperature and then add KOH (1.12 g, 0.002 mol) to form a fourth mixture and stir the forth mixture overnight to neutralize PTSA. Add magnesium silicate (10 g) to the forth mixture to form a fifth mixture and stir at 60° C. for 3 hours to absorb the generated salt in the fifth mixture. Filter the fifth mixture through a filter paper. After filtration, remove the residue solvent by vacuum distillation to obtain a light yellow liquid (388 g, yield=84%, mol capping rate=94%).

Esterification of OSP12 by Isovaleric Acid (OSP12-iC5)

Stir UCON™OSP-12 (374 g, 1 mol) and isovaleric acid (102 g, 1 mol) in toluene (500 mL) at room temperature (23° C.) to form a first mixture. Add PTSA (1.90 g, 0.001 mol) with stirring to the first mixture to form a second mixture. Reflux the second mixture at 135° C. for overnight with Dean-Stark to remove 18.0 mL water to form a third mixture. Cool the third mixture to room temperature and then add KOH (1.12 g, 0.002 mol) to form a fourth mixture and stir the forth mixture overnight to neutralize PTSA. Add magnesium silicate (10 g) to the forth mixture to form a fifth mixture and stir at 60° C. for 3 hours to absorb the generated salt in the fifth mixture. Filter the fifth mixture through a filter paper. After filtration, remove the residue solvent by vacuum distillation to obtain a light yellow liquid (376 g, yield=82%, mol capping rate=96%).

Esterification of OSP12 by Capiylic Acid (OSP12-C8)

Stir UCON™OSP-12 (374 g, 1 mol) and caprylic acid (144 g, 1 mol) in toluene (500 mL) at room temperature (23° C.) to form a first mixture. Add PTSA (1.90 g, 0.001 mol) with stirring to the first mixture to form a second mixture. Reflux the second mixture at 135° C. for 5 hours with Dean-Stark to remove 18.0 mL water to form a third mixture. Cool the third mixture to room temperature and then add KOH (1.12 g, 0.002 mol) to form a fourth mixture and stir the forth mixture overnight to neutralize PTSA. Add magnesium silicate (10 g) to the forth mixture to form a fifth mixture and stir at 60° C. for 3 hours to absorb the generated salt in the fifth mixture. Filter the fifth mixture through a filter paper. After filtration, remove the residue solvent by vacuum distillation to obtain a light yellow liquid (420 g, yield=84%, mol capping rate=95%).

Formulation Preparation

Prepare formulations by adding each component of the formulation as identified in Tables 2 to 4 into a 200 mL glass beaker to from a 100 mL sample. Each resulting formulation was clear and homogenous.

Evaluation of Friction Behavior of OSP-Esters in Hydrocarbon Oils

Friction Testing Method

Use a Mini-Traction Machine (MTM) to measure friction in which steel ball rotates on a steel disc. The steel disc is steel (AISI 52100) having a diameter of 45 mm and hardness of 750HV with a Ra<0.02 micrometers. The ball is steel (AISI 52100) having a diameter of 19 mm and a hardness 750HV with a Ra<0.02 micrometers. Generate Stribeck curves using a load of 37N, a speed range from of 2000 mm/sec to 3 m m/sec, slide-roll-ratio of 50% and temperatures of 80° C. and 120° C. Friction coefficients are reported at 10 and 30 mm/sec.

The treat level of OSP or OSP-ester in the hydrocarbon base oils in the friction experiments was 5% (weight).

TABLE 2

Results of Friction Testing of OSP and OSP-esters at 5% treat level.

| Ex or Comp. Ex | Formulation | Friction coefficient at 80° C. speed 10 mm/s | Friction coefficient at 80° C., speed 30 mm/s | Friction coefficient at 120° C., speed 10 mm/s | Friction coefficient at 120° C., speed 30 mm/s |
|---|---|---|---|---|---|
| Comp. Ex. A | GpIII | 0.099 | 0.073 | 0.100 | 0.073 |
| Comp. Ex. B | GpIII + OSP18 | 0.093 | 0.070 | 0.091 | 0.069 |
| Example 1 | GpIII + OSP18/ C5 ester | 0.056 | 0.052 | 0.059 | 0.041 |
| Example 2 | GpIII + OSP18/ i-C5 ester | 0.064 | 0.056 | 0.063 | 0.049 |
| Example 3 | GpIII + OSP18/ C8 ester | 0.082 | 0.068 | 0.073 | 0.057 |
| Example 4 | GpIII + OSP12/ C5 ester | 0.060 | 0.054 | 0.060 | 0.061 |
| Example 5 | GpIII + OSP12/ iC5 ester | 0.078 | 0.065 | 0.068 | 0.062 |
| Example 6 | GpIII + OSP12/ C8 ester | 0.076 | 0.069 | 0.084 | 0.067 |
| Comp Ex C | PAO-6 | 0.082 | 0.061 | 0.093 | 0.062 |
| Comp Ex. D | PAO-6 + OSP18 | 0.076 | 0.058 | 0.086 | 0.066 |
| Example 7 | PAO-6 + OSP18/ C5 ester | 0.067 | 0.057 | 0.065 | 0.046 |

Table 2 shows the friction behavior of three OSP18-esters compared to UCON OSP-18 in a Group III hydrocarbon base oil (Comp. Ex B). At temperatures of 80° C. and 120° C. the virgin hydrocarbon base oil (Comp Ex A) shows the highest friction values followed by OSP-18 in Group III base oil. The compositions of esters of OSP-18 in Group III base oil demonstrated improved friction reducing behavior.

Table 2 also shows the friction behavior of compositions of three OSP12-esters compared to UCON OSP-18 in a Group III hydrocarbon base oil (Comp. Ex B). At temperatures of 80° C. and 120° C. the virgin hydrocarbon base oil (Comp. Ex A) shows the highest friction values followed by the composition of OSP-18 in Group III base oil. The esters of OSP-12 demonstrated improved friction reducing behavior.

Table 2 also shows an example of the effect of an OSP-ester in a PAO base oil. Friction coefficient values are lower for the composition containing the OSP-ester (Ex. 7) versus the reference PAO-6 and PAO-6 with OSP18 (Comp Ex. D). Thus the effect is not simply unique to a Group III base oil but also a Group IV (PAO).

Collectively the data in Table 2 demonstrates the improved frictional performance of OSP-esters over an OSP (non-esterified).

Evaluation of Viscosity Index & Low Temperature Properties of OSP-Esters in Hydrocarbon Oils In many industrial lubricant formulations (such as gear oils) and some automotive lubricants, compositions with high viscosity indices are desired. Hydrocarbon base oils typically have low viscosity index values and often <200. Addition of other base oils such as polyisobutylenes can improve their viscosity indices. In addition to high viscosity index values, lubricants are preferred which have low viscosities at low temperatures (e.g. 0° C.). This can improve their pump ability. Generally Group I-III hydrocarbon oils have high viscosities at 0° C. Group IV (PAOs) have better low temperature properties. The following examines whether the inclusion of esterified OSPs can both increase the viscosity index and decrease $KV_0$ values compared to a hydrocarbon oil (PAO) alone and also a hydrocarbon oil with an OSP.

Calculate kinematic viscosities at 0° C., 40° C. and 100° C. ($KV_0$, $KV_{40}$ and $K_{100}$) by measuring dynamic viscosity according to ASTM D7042. Calculate the viscosity indices of compositions using ASTM D7042. Use the kinematic viscosity at 0° C. to assess low temperature behavior. Lower values are preferred. For viscosity index, then higher values are preferred.

TABLE 3

| Blend Compositions | | | | | | | | |
|---|---|---|---|---|---|---|---|---|
| | Weight percent | | | | | | | |
| Formulation, # | Comp Ex E | Comp Ex F | Ex 8 | Ex 9 | Comp Ex G | Comp Ex H | Ex 10 | Ex 11 |
| PAO100, % | 90 | 90 | 90 | 90 | 50 | 50 | 50 | 50 |
| PAO8, % | 10 | | | | 50 | | | |
| OSP18, % | | 10 | | | | 50 | | |
| OSP18-C2, % | | | 10 | | | | 50 | |
| OSP18-C3, % | | | | 10 | | | | 50 |
| Formulation properties | | | | | | | | |
| $KV_{40}$, cSt | 659 | 572 | 482 | 506 | 197 | 102 | 98.8 | 87.3 |
| $KV_{100}$, cSt | 76.7 | 70.6 | 62.3 | 64.9 | 27.5 | 16.9 | 17.5 | 16.2 |
| $KV_0$, cSt | 7524 | 6228 | 4903 | 5187 | 1876 | 949 | 842 | 661 |
| VI | 198 | 202 | 203 | 204 | 177 | 181 | 195 | 200 |

Table 3 describes Comparative Examples E-H and Inventive Examples 8-11. These formulations use a Group IV PAO base oil which is PAO-100. Comp. Exs. E and F and Exs. 8 and 9 were aiming to create compositions with a $KV_{100}$ of about 70 cSt. Comp. Ex. E was a simple PAO mixture with a VI of 198. Comp. Ex. B was a blend of PAO and OSP-18. The inclusion of OSP-18 showed a minor increase in VI and decrease in $KV_0$. Ex. 8 and Ex. 9 can be directly compared with Comp. Ex. F., Ex 8 and Ex 9 both show a further increase in VI and a decrease in $KV_0$ for a treat level of 10% of the Esterfied-OSPs. Comp. Exs. G and H and Exs. 10 and 11 were aiming to create products with a $KV_{100}$ of about 17 cSt. Comp. Ex. H which contained OSP-18 had a VI of 181. Examples 10 and 11 which contained 50% of Esterified-OSPs instead of OSP-18 showed a further increase in VI and a further reduction in $KV_0$. Comp Ex. G was a simple PAO mixture with a VI of 177. It has a higher $KV_{100}$ value but its VI is the lowest and $KV_0$ is the highest.

Note that OSP18, OSP18-C2 ester and OSP8-C3 ester have similar $KV_{40}$ and $KV_{100}$ values making a direct comparison of their differences realistic when included as co-base fluids in the PAO.

TABLE 4

| Blend Compositions | | | |
|---|---|---|---|
| Formulation, # | Comp Ex I | Comp Ex J | Ex 12 |
| PAO100, % | 75 | 75 | 75 |
| OSP12, % | 25 | | |
| OSP18, % | | 25 | |
| OSP12-C5, % | | | 25 |
| Formulation properties | | | |
| $KV_{40}$, cSt | 231.9 | 261.0 | 222.8 |
| $KV_{100}$, cSt | 35.0 | 37.5 | 35.7 |

TABLE 4-continued

| Blend Compositions | | | |
|---|---|---|---|
| Formulation, # | Comp Ex I | Comp Ex J | Ex 12 |
| $KV_0$, cSt | 2193 | 2658 | 1906 |
| VI | 200 | 195 | 210 |

Table 4 describes Comparative Examples I and J and Inventive Example 12. Comp. Exs. I and J and Ex. 12 were targeting a $KV_{100}$ values of about 35 cSt. Ex. 12, which contained an Esterified OSP (OSP12-C5) showed a much higher VI and lower $KV_0$ value.

We claim:

1. A lubricant formulation, comprising:

a base oil; and an esterified oil-soluble polyalkylene glycol (E-OSP) of Formula I:

$$R^1[O(R^2O)_n(R^3O)_m(C{=}O)R^4]_p \qquad \text{Formula I}$$

wherein $R^1$ is a linear alkyl having 1 to 18 carbon atoms, a branched alkyl having 4 to 18 carbon atoms or an aryl with 6 to 30 carbon atoms; $R^2O$ is an oxypropylene moiety derived from 1,2-propylene oxide; $R^3O$ is an oxybutylene moiety derived from butylene oxide, wherein $R^2O$ and $R^3O$ are in a block or a random distribution; $R^4$ is a linear alkyl with 1 to 18 carbon atoms, a branched alkyl with 4 to 18 carbon atoms or an aryl with 6 to 18 carbon atoms; n and m are each independently integers ranging from 5 to 10, and p is an integer from 1 to 4.

2. The lubricant formulation of claim 1, wherein $R^3O$ is derived from 1,2-butylene oxide.

3. The lubricant formulation of claim 1, wherein $R^4$ is a linear alkyl with 1 to 8 carbon atoms.

4. The lubricant formulation of claim 1, wherein $R^1$ is a linear alkyl with 10 to 14 carbon atoms.

5. The lubricant formulation of claim 1, wherein the lubricant formulation further includes an oil-soluble polyalkylene glycol (OSP) of Formula II:

$$R^1[O(R^2O)_n(R^3O)_m]_p{-}H \qquad \text{Formula II}$$

wherein $R^1$ is a linear alkyl having 1 to 18 carbon atoms, a branched alkyl having 4 to 18 carbon atoms or an aryl with 6 to 18 carbon atoms; $R^2O$ is an oxypropylene moiety derived from 1,2-propylene oxide; $R^3O$ is an oxybutylene moiety derived from butylene oxide, wherein $R^2O$ and $R^3O$ are in a block or a random distribution; n and m are each independently integers ranging from 0 to 20 wherein n+m is greater than 0, and p is an integer from 1 to 4, wherein the OSP of Formula II is soluble in the base oil.

6. The lubricant formulation of claim 1, wherein the lubricant formulation further includes an oil-soluble acid of Formula III:

$$R^4—COOH \qquad \text{Formula III}$$

$R^4$ is a linear alkyl with 1 to 18 carbon atoms, a branched alkyl with 4 to 18 carbon atoms or an aryl with 6 to 18 carbon atoms, wherein the acid of Formula III is soluble in the base oil.

7. The lubricant formulation of claim 1, wherein the lubricant formulation includes 90 to 99.9 weight percent (wt. %) of the base oil and 10 to 0.01 wt. % of the E-OSP of Formula I, wherein the wt. % is based on the total weight of the lubricant formulation.

8. The lubricant formulation of claim 7, wherein the lubricant formulation includes 95 wt. % of the base oil and 5 wt. % of the E-OSP of Formula I.

9. The lubricant formulation of claim 1, wherein the base oil is selected from the group consisting of an American Petroleum Institute (API) Group I hydrocarbon base oil, an API Group II hydrocarbon base oil, an API Group III hydrocarbon base oil, an API Group IV hydrocarbon base oil and a combination thereof.

10. The lubricant formulation of claim 1, wherein the base oil is an API Group III hydrocarbon base oil.

11. A method of forming a lubricant formulation for an internal combustion engine, comprising:

providing the base oil; and admixing with the base oil an esterified oil-soluble polyalkylene glycol (E-OSP) of Formula I:

$$R^1[O(R^2O)_n(R^3O)_m(C{=}O)R^4]_p \qquad \text{Formula I}$$

wherein $R^1$ is a linear alkyl having 1 to 18 carbon atoms, a branched alkyl having 4 to 18 carbon atoms or an aryl with 6 to 30 carbon atoms; $R^2O$ is an oxypropylene moiety derived from 1,2-propylene oxide; $R^3O$ is an oxybutylene moiety derived from butylene oxide, wherein $R^2O$ and $R^3O$ are in a block or a random distribution; $R^4$ is a linear alkyl with 1 to 18 carbon atoms, a branched alkyl with 4 to 18 carbon atoms or an aryl with 6 to 18 carbon atoms; n and m are each independently integers ranging from 5 to 10, and p is an integer from 1 to 4, to form the lubricant formulation for the internal combustion engine.

12. The method of claim 11, wherein $R^3O$ is derived from 1,2-butylene oxide.

13. The method of claim 11, wherein $R^4$ is a linear alkyl with 1 to 8 carbon atoms.

14. The method of claim 11, wherein $R^1$ is a linear alkyl with 10 to 14 carbon atoms.

15. The method of claim 11, wherein the lubricant formulation includes 90 to 99.9 weight percent (wt. %) of the base oil and 10 to 0.01 wt. % of the E-OSP of Formula I, wherein the wt. % is based on the total weight of the lubricant formulation.

16. The method of claim 15, wherein the lubricant formulation includes 95 wt. % of the base oil and 5 wt. % of the E-OSP of Formula I.

17. The method of claim 11, wherein the base oil is selected from the group consisting of an American Petroleum Institute (API) Group I hydrocarbon base oil, an API Group II hydrocarbon base oil, an API Group III hydrocarbon base oil, an API Group IV hydrocarbon base oil and a combination thereof.

18. The method of claim 11, wherein the base oil is an API Group III hydrocarbon base oil.

* * * * *